US005819563A

United States Patent [19]

Bianco

[11] Patent Number: 5,819,563

[45] Date of Patent: Oct. 13, 1998

[54] INTELLIGENT LOCK SYSTEM

[76] Inventor: James S. Bianco, 217 Brainard Rd., Enfield, Conn. 06082

[21] Appl. No.: 901,005

[22] Filed: Jul. 28, 1997

Related U.S. Application Data

[63] Continuation of Ser. No. 395,417, Feb. 27, 1995, abandoned, which is a continuation-in-part of Ser. No. 985,840, Dec. 3, 1992, abandoned, which is a continuation-in-part of Ser. No. 921,418, Jul. 27, 1992, abandoned, which is a continuation-in-part of Ser. No. 780,155, Oct. 21, 1991, abandoned.

[51] Int. Cl.[6] ..... E05B 49/00

[52] U.S. Cl. ..... 70/278; 70/283; 70/389; 70/422; 70/432; 70/434; 70/472

[58] Field of Search ..... 70/53, 277, 278, 70/383, 389, 422, 432–434, DIG. 49, 188, 189, 222, 223, 472, 279–282; 361/212, 216, 220

[56] References Cited

U.S. PATENT DOCUMENTS

| | | | |
|---|---|---|---|
| 2,136,859 | 11/1938 | Michel | 70/278 |
| 2,475,220 | 7/1949 | Chaulk et al. | 70/283 |
| 4,325,240 | 4/1982 | Gable | 70/433 X |
| 4,546,345 | 10/1985 | Naito | 70/DIG. 49 X |
| 4,616,491 | 10/1986 | Genest | 70/278 X |
| 4,762,212 | 8/1988 | Fish et al. | 70/283 X |
| 4,909,053 | 3/1990 | Zipf, III et al. | 70/284 X |
| 5,140,317 | 8/1992 | Hyatt, Jr. et al. | 235/382 X |
| 5,351,042 | 9/1994 | Aston | 70/278 X |

FOREIGN PATENT DOCUMENTS

| | | | |
|---|---|---|---|
| 0293137 | 11/1988 | European Pat. Off. | 70/278 |
| 4080482 | 3/1992 | Japan | 70/408 |
| 1441682 | 7/1976 | United Kingdom | 70/277 |

*Primary Examiner*—Lloyd A. Gall
*Attorney, Agent, or Firm*—John H. Crozier

[57] ABSTRACT

In a preferred embodiment, a lock system including a lock and a key, including: a lock housing; a rotatable member disposed in the housing, rotation of which rotatable member selectively effects locking and unlocking of the lock; blocking apparatus operatively connected to the rotatable member to prevent unlocking of the lock except upon receipt of an electrical unlocking signal; key apparatus having an end insertable in the housing and into an end of the rotatable member for rotation of the rotatable member; and apparatus to permit a portion of the rotatable member to rotate without damage to any elements of the lock if rotation of the rotatable member is attempted without receipt of the electrical unlocking signal.

8 Claims, 17 Drawing Sheets

A: KEY INSERTION
B: PRESENSE SENSE
C: CHARGE
D: BIDIRECTIONAL COMMUNICATION
E: UNLOCK
F: UNLOCK MONITOR
G: LOCKED
H: KEY REMOVED

INTELLIGENT LOCK SYSTEM

CROSS-REFERENCE TO RELATED TO APPLICATIONS

This application is a continuation of application Ser. No. 08/395,417, filed Feb. 27, 1995, now abandoned, which is a continuation-in-part of Ser. No. 07/985,840, abandoned, filed Dec. 3, 1992, which is a continuation-in-part of Ser. No. 07/921,418, filed Jul. 27, 1992, abandoned, which is a continuation-in-part of Ser. No. 07/780,155, filed Oct. 21, 1991, abandoned.

BACKGROUND OF THE INVENTION

1. Field of the Invention

The present invention relates to locking systems generally and, more particularly, to a novel intelligent lock system which is particularly useful for locks on coin operated telephones and locks on cargo containers.

2. Background Art

While the present invention is described with reference to locks on coin operated telephones or cargo containers, for illustrative purposes, it will be understood that it may be applied as well in any application in which it is desirable to be able to unlock a number of locks with a single unlocking mechanism.

The coin boxes in coin operated telephones must be removed periodically to remove the coins. Conventionally, this is done by giving a coin collector a large shackle of keys which holds a unique key for each telephone which is to be opened to remove the coin boxes therein on a particular day. As prior steps, the telephone boxes to be accessed must be identified, the appropriate keys pulled, and a route form prepared. The coin collector goes to each telephone, selects the proper key, uses the key to operate a lock release mechanism, uses another key to open the coin box access door on the telephone, removes the coin box, checks the coin box number against the one printed on the route form, and inserts an empty coin box. The empty receptacle number is recorded on the route sheet and the receptacle stub along with the time, date, and collector number. This system is cumbersome and time consuming, since the coin collector must take time to select the correct key for each telephone and make proper notations to assure that a coin box is identified to a particular telephone. The latter step introduces opportunity for error.

It has been proposed to employ an "intelligent key" for use in unlocking coin operated telephones. The key would be programmed, by a main computer, to unlock, say, 100 telephones on a given day. The coin collector would use a bar code reading wand attached to the intelligent key to read a bar code attached to an outside surface of the telephone to obtain the identification of the telephone. The smart key would look up the identification in its programmable memory to verify that the telephone is one that can be unlocked on that day. The intelligent key is then inserted in the lock and the lock mechanism released by means of data transfer between the two. Bar codes on the full and empty coin boxes are scanned and this data is inputted to a memory in the intelligent key. While this system is an improvement over the conventional method of accessing coin boxes, it has the substantial disadvantage of having to read external indicia for verification of the telephone. Such external indicia are subject to damage or removal which represents a substantial maintenance cost and which requires manual input of the information to the key.

A further disadvantage of conventional locks is that the slots in which keys are inserted can easily accumulate dirt, gum, etc., which foreign matter is difficult to remove.

Another disadvantage of conventional electronic locks is that, when an unauthorized user tries to unlock the lock by force, the mechanism preventing opening is frequently broken which, of course, requires repair before the lock can be used normally. If not properly constructed, the breaking of the mechanism can even open the lock.

A disadvantage of conventional locks used with cables, such as on cargo containers, is that the cable may be deliberately severed, the contents of the containers accessed, and then the cable repaired without any evidence of the same when the container is delivered to its destination.

An additional disadvantage of conventional electronic locks is that the key is often charged with static electricity which interferes with the communication between the lock and the key.

Accordingly, it is a principal object of the present invention to provide a system for unlocking a coin operated telephone which does not rely on reading external indicia to identify the telephone.

It is a further object of the invention to provide such a system in which the lock mechanism itself identifies the telephone.

It is another object of the invention to provide such a system which permits a single programmable unlocking mechanism to selectively unlock a large number of locks.

It is an additional object of the invention to provide such a system that is conveniently and easily employed.

If is yet a further object of the invention to provide such a system in which openings in which key means are inserted are relatively immune to accumulating foreign matter and are easily cleaned thereof.

It is yet another object of the invention to provide such a system in which nothing in the lock mechanism can be broken by an unauthorized attempt to forcibly unlock the lock.

It is yet an additional object of the invention to provide such a system in which the key is automatically grounded before electrical communication between the key and the lock is established.

Another object of the invention is to provide an indication that a cable secured by an electronic lock has been broken and repaired.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing, in a preferred embodiment, a lock system including a lock and a key, comprising: a lock housing; a rotatable member disposed in said housing, rotation of which rotatable member selectively effects locking and unlocking of said lock; blocking means operatively connected to said rotatable member to prevent unlocking of said lock except upon receipt of an electrical unlocking signal; key means having an end insertable in said housing and into an end of said rotatable member for rotation of said rotatable member; and means to permit a portion of said rotatable member to rotate without damage to any elements of said lock if rotation of said rotatable member is attempted without receipt of said electrical unlocking signal.

BRIEF DESCRIPTION OF THE DRAWING

Understanding of the present invention and the various aspects thereof will be facilitated by reference to the accompanying drawing figures, submitted for purposes of illustration only and not intended to define the scope of the invention, in which.

DETAILED DESCRIPTION OF THE PREFERRED EMBODIMENTS

Figure 1:
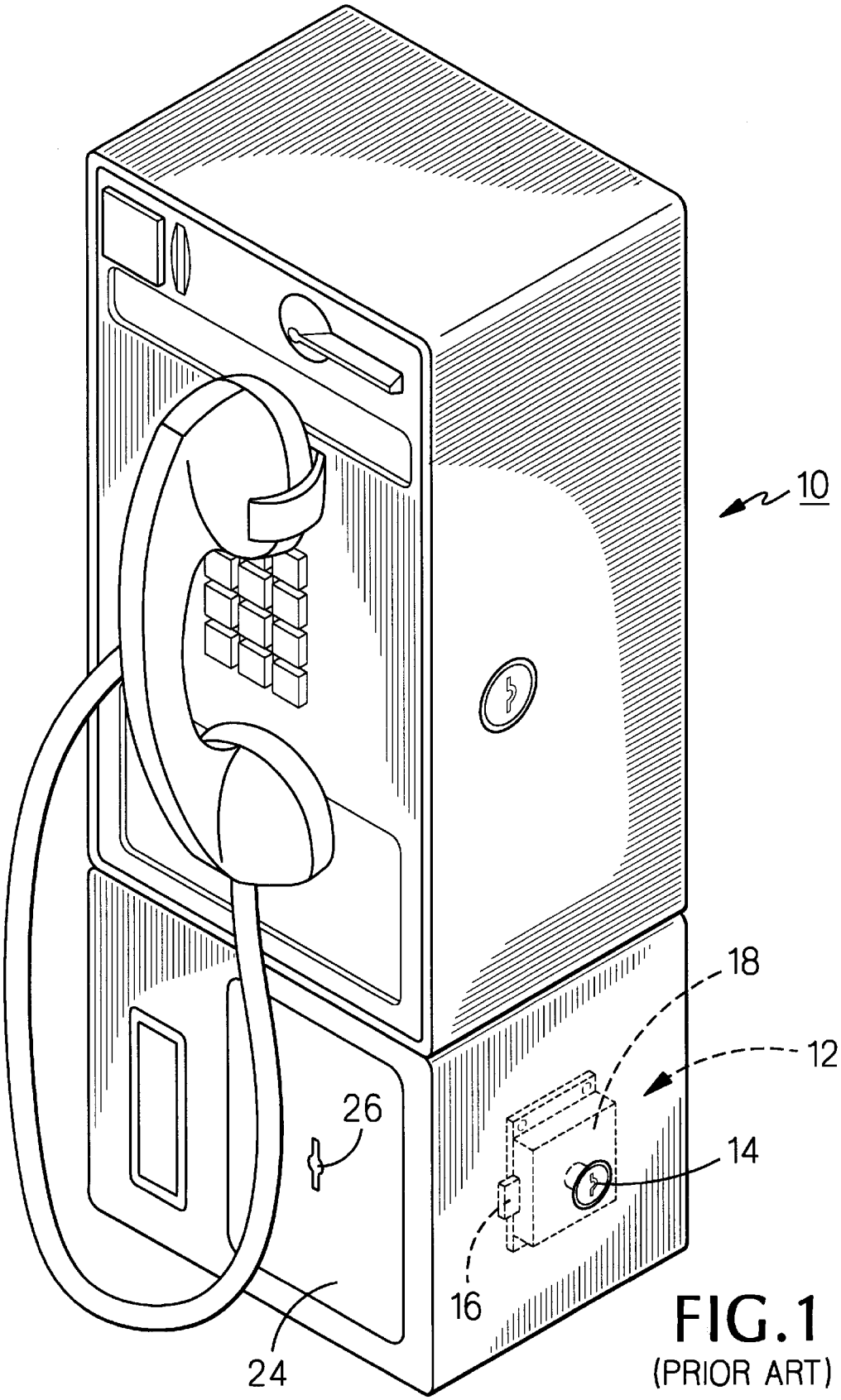
FIG.1 (PRIOR ART)
FIG. 1 is a perspective view of a conventional coin operated telephone.

Reference should now be made to the Drawing, in which similar or identical elements are given consistent identifying numerals throughout the various figures thereof, and in which reference numerals in parentheses direct the reader to the figure(s) in which the element(s) being described are best seen, although the element(s) may be seen in other figure(s) also.

FIG. 1 illustrates a conventional coin operated telephone, generally indicated by the reference numeral 10. Since telephone 10 is conventional, only those elements thereof with which the present invention is concerned will be described. It will be understood that the base of telephone 10 includes a coin box (not shown) into which fall coins inserted into the telephone to permit operation thereof. Telephone 10 includes a lock mechanism, generally indicated by the reference numeral 12, which has a tumbler slot 14 into which a wrench (not shown) can be inserted to permit a slide bolt 16 to be withdrawn into the housing 18 of the mechanism. Once slide bolt 16 is so withdrawn, an internal mechanism (not shown) permits access door 24 to be opened by insertion of a key (not shown) into key slot 26. This operation gives access to the coin box as is more fully described above.

Figure 2:
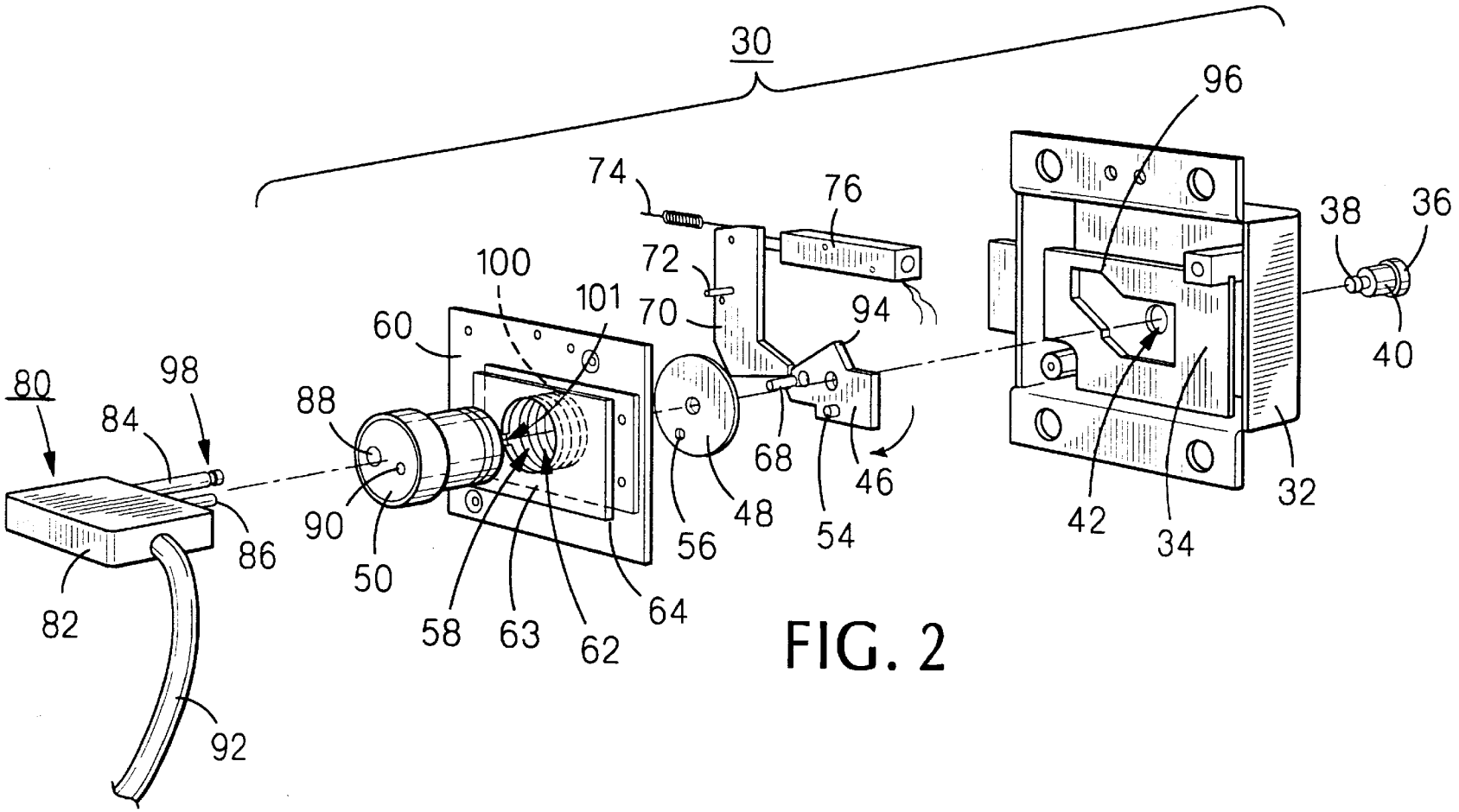
FIG. 2 is an exploded perspective view of one embodiment of the present invention.

FIG. 2 illustrates one embodiment of a lock mechanism according to the present invention, generally indicated by the reference numeral 30. Lock mechanism 30 includes a housing 32 in which is disposed for sliding back and forth movement a slide bolt 34. A support pin 36 having a threaded distal portion 38 and an intermediate unthreaded portion 40 is inserted through an opening 42 defined in the rear wall of housing 32, with the unthreaded portion engaging the wall of the opening. Disposed on unthreaded portion 40 are a cam 46 and a printed circuit board 48. The threaded end of support pin 36 engages a barrel 50 so that, unless otherwise impeded, the support pin and the barrel will rotate together. A shear pin 54 fixed to cam 46 extends through an opening 56 defined in printed circuit board 48 and into barrel 50 so that those elements will rotate with the barrel and support pin 36.

Barrel 50 extends through an opening 62 defined in a anti-removal retainer 64 which is fixedly attached to the face of side panel 60 of a telephone (not shown) and through an opening 58 defined in the side panel. A cover plate 63 is fixedly attached over anti-removal retainer 64 so, with the elements of lock mechanism assembled as described above, those elements cannot be extracted from the telephone without disassembly of the telephone.

The rotatable elements 50, 48, 46, and 36, of lock mechanism 30 are prevented from rotation in the direction indicated by the arrow shown on FIG. 2 by means of a latch pin 68 fixedly attached to cam 46 which latch pin engages the bottom of a latch bar 70 rotatably attached to side panel 60 by means of a shaft 72. Latch bar 70 is held in the position shown by means of a return spring 74 attached to side panel 60. Also attached to side panel 60 is a solenoid 76 operatively connected to the upper end of latch bar 70 to withdraw the latch bar from engagement with latch pin 68 and permit the above noted rotatable elements of lock mechanism 30 to rotate.

The means by which lock mechanism 30 is unlocked includes a wrench, generally indicated by the reference numeral 80. Wrench 80 includes a housing 82 with a data probe 84 and a pin 86 extending therefrom. Data probe 84 and pin 86 are insertable into lock mechanism 30 through channels 88 and 90, respectively, defined in barrel 50. Data probe 84 extends through barrel 50 and contacts printed circuit board 48, while pin 86 terminates in the barrel. Probe 84 is of the spring loaded type. Wrench 80 is connected to a computer (described below) by means of a cable 92.

In operation, wrench 80 is inserted in lock mechanism 30 so that probe 84 contacts printed circuit board 48. When appropriate signals have been exchanged over cable 92, solenoid 76 is activated causing the disengagement of latch bar 70 from latch pin 68 and the wrench can then be rotated clockwise as indicated by the arrow. Such rotational movement causes sliding engagement of a cam surface 94 with a shoulder 96 formed on slide bolt 34 causing the slide bolt to withdraw its distal end into housing 32, thus releasing an internal mechanism (not shown) in the telephone as described above with reference to a conventional telephone lock mechanism. Data probe 84 includes an annular channel 98 which engages the edge of a cut-out 100 in opening 62 to prevent removal of wrench 80 when lock mechanism 30 is in its unlocked state.

The opening defined by cutout 100 is radially offset from opening 62. As wrench 80 is inserted into barrel 50 in lock mechanism 30, the distal end of data probe 84 passes through a notch 101 defined in the edge of cutout 100. When wrench 80 is fully inserted into barrel 50, the edge of cutout 100 and annular channel 98 are axially aligned, so that rotation of wrench 80 causes the engagement of the edge of the cutout and the channel, preventing removal of the wrench.

Figure 3:
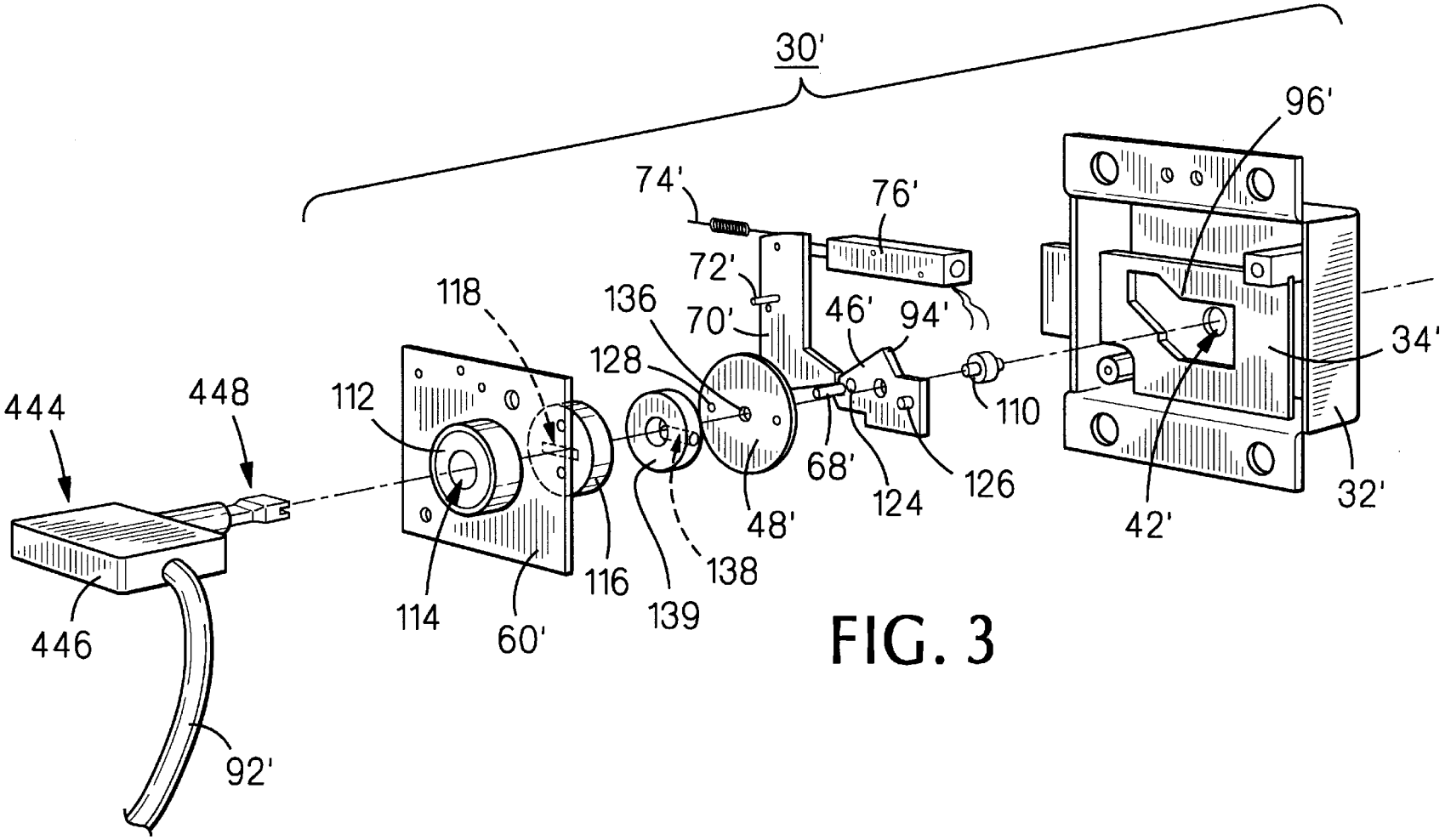
FIG. 3 is an exploded perspective view of another embodiment of the present invention.

FIG. 3 illustrates another embodiment of a lock mechanism, generally indicated by the reference numeral 30'. Elements of lock mechanism identical, or nearly so, to those of lock mechanism 30 of FIG. 2 are given primed reference numerals. Lock mechanism 30' includes a support pin journaled for rotating motion in opening 42' and having a smooth shaft portion 110 on which is mounted cam 46'. Lock mechanism 30' further includes a barrel 112 fixedly attached to side panel 60' and having an axial channel 114 defined centrally therethrough. An anti-removal retainer 116 having a slotted opening 118 defined therethrough and aligned with channel 114 is fixedly attached to side panel 60'. Cam 46' has holes 124 and 126 defined therethrough for fasteners (not shown) which pass through holes 128 and 130 defined through printed circuit board 48' and into a rotation ring 139 to fasten those three elements together so that they are rotatable as a unit. Rotation ring 139 has a channel 136 defined therethrough axially aligned with channel 114 and opening 118. Extending radially into channel 136 is a shear pin 138.

Figure 4A:
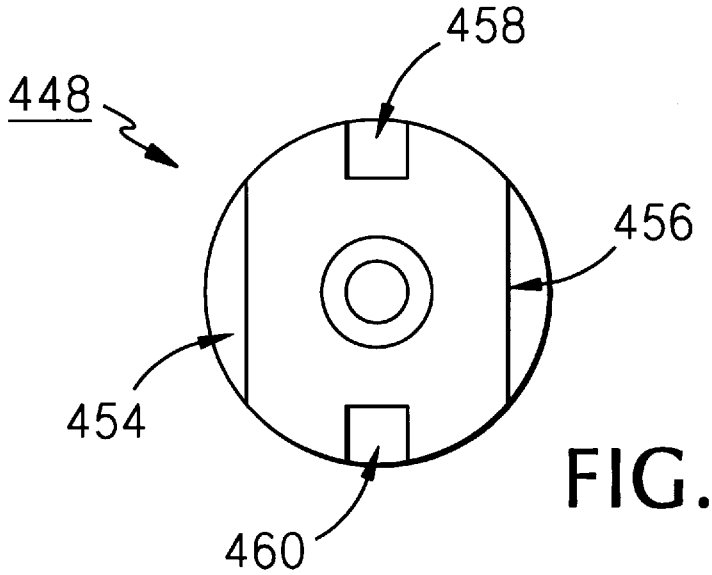
FIGS. 4A and 4B illustrate details of the embodiment of FIG. 3.
Figure 4B:
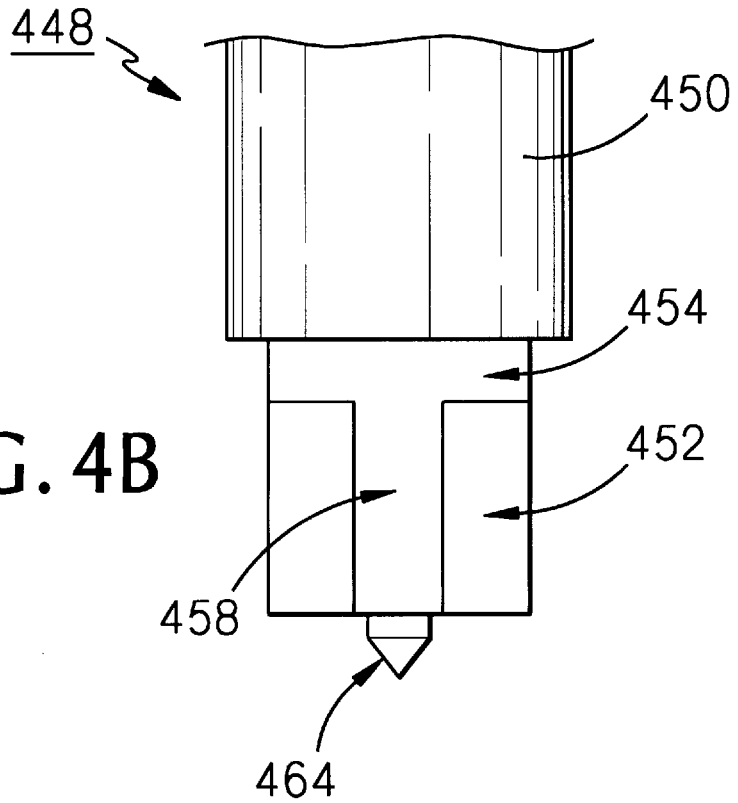

Unlocking of lock mechanism 30' effects the same result as the unlocking of lock mechanism 30 (FIG. 2); however, lock mechanism 30' employs a different wrench, generally indicated by the reference numeral 444. Wrench 444 includes a housing 446 and a probe, generally indicated by the reference numeral 448. With reference also now to FIGS. 4A and 4B, probe 448 includes a shaft portion 450 and a distal tip portion 452, between which is an annular channel 454. Distal tip portion 452 includes two flats 456 spaced apart by 180 degrees on opposite sides of the tip portion and two channels 458 and 460 spaced apart by 180 degrees on opposite sides of the tip portion intermediate the flats. A spring loaded probe tip 464 extends from tip portion 452.

The elements of lock mechanism 30' are configured so that distal tip portion 452 may pass through channel 114. Flats 456 permit passage of tip portion 452 through slotted opening 118 in one orientation, but not if wrench 444 is rotated from that orientation. Tip portion 452 may be inserted in channel 136 and, when the orientation of the tip portion to rotation ring 134 is as shown on FIG. 3, shear pin 138 will be captured in one of channels 458 and 460. When wrench 444 is so inserted in lock mechanism 30', probe tip 464 will contact printed circuit board 48'.

With wrench 444 so inserted in lock mechanism 30' and the appropriate signals having been exchanged over cable 92', solenoid 76' will be activated, withdrawing latch bar from engagement with latch pin 68' and cam 46' may be rotated clockwise as indicated by the arrow, by virtue of the engagement of shear pin 138 with one of channels 458 and 460 (FIGS. 4A and 4B).

Lock mechanisms 30 and 30' cannot be unlocked by brute force with a tool fabricated for that purpose, since shear pins 54 and 138, respectively, will be severed by rotation of the tool, absent activation of solenoids 76 and 76' which breaks mechanical communication between a tool inserted in the lock mechanisms and cams 46 and 46'. Shear pins 54 and 138 are selected of such diameter and material that they can be forcibly severed much more easily than latch pins 68 and 68', respectively. Were the situation reversed, the latch pins would be severed, the cams would be rotatable, and the respective lock mechanisms 30 and 30' could be unlocked by brute force.

Figure 5:
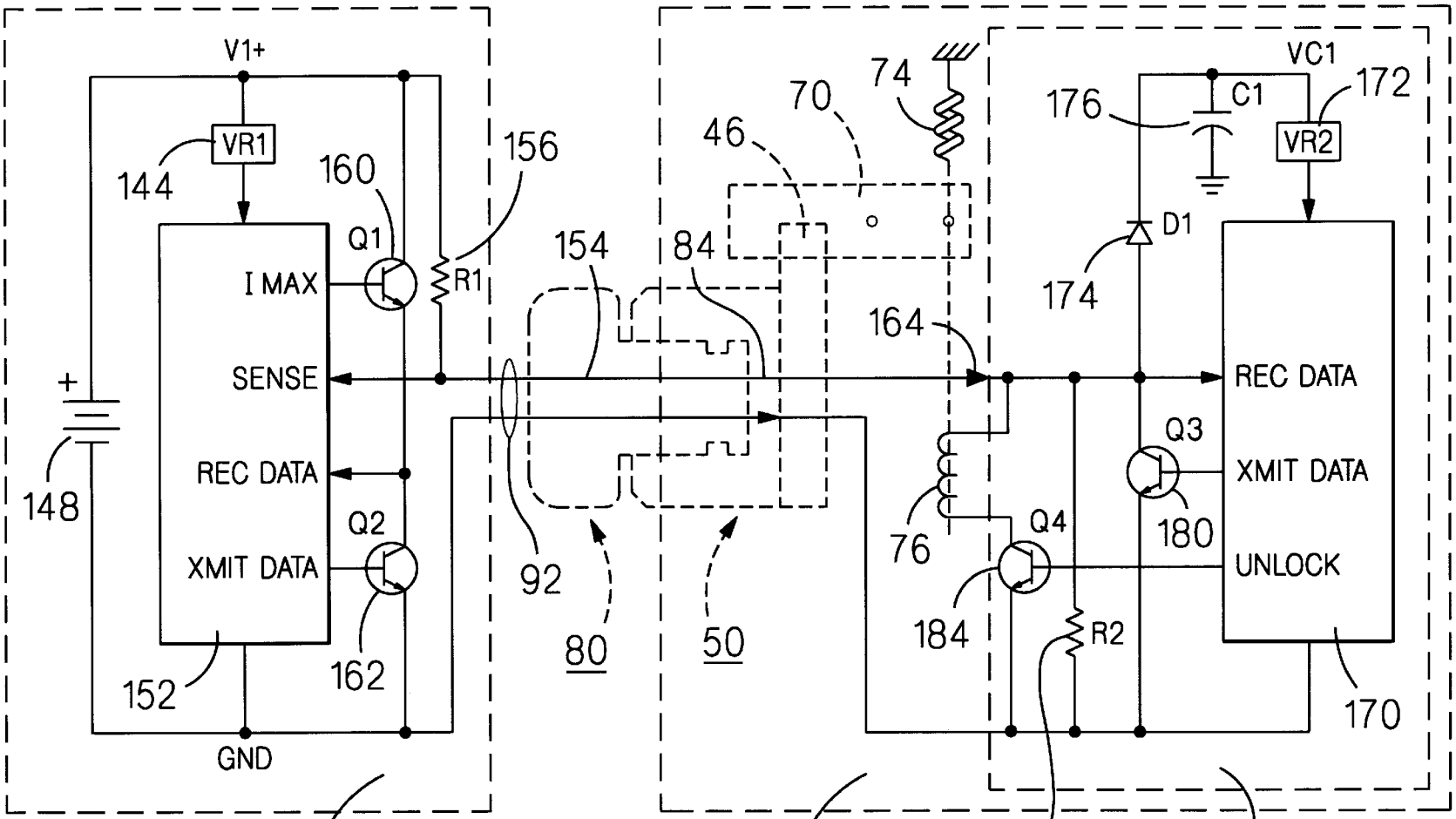
FIG. 5 is a block/schematic diagram of the embodiment of FIG. 2.
Figure 6:
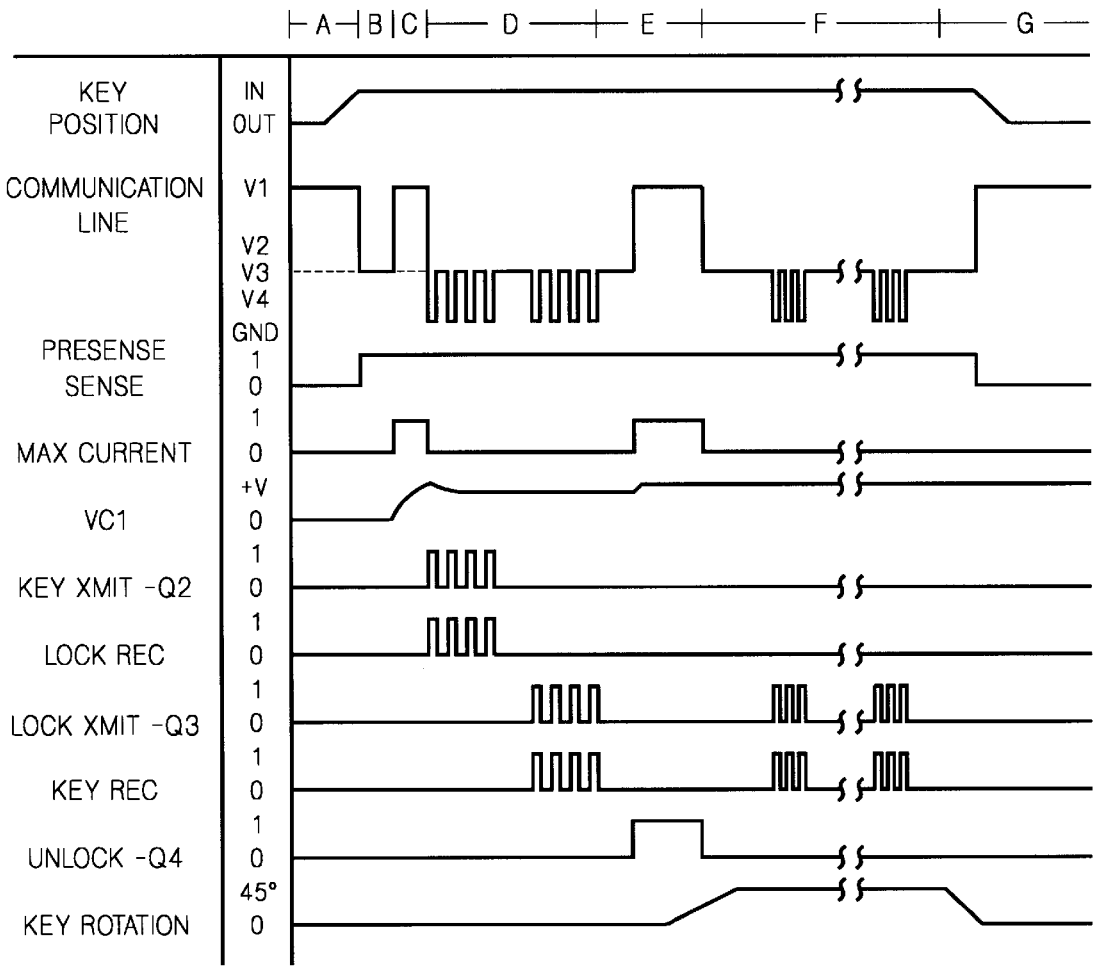
FIG. 6 is a timing/logic diagram illustrating the operation of the present invention.

Reference now to FIGS. 5 and 6 together will aid in understanding the operation of the present invention.

While the reference numerals on FIG. 5 are given for the embodiment shown on FIG. 2, it will be understood that the schematic applies as well to the embodiment on FIG. 3. On FIG. 5, a computer 150 includes a microprocessor 152 which receives operating power from a voltage regulator 144 which is connected to internal battery 148 when computer 150 is configured as a portable unit. The power source, here, battery 148, is also connected to a communication line 154 in cable 92 through a resistor 156. Microprocessor 152 provides outputs to a maximum power switching transistor 160 and to a data transmitting switching transistor 162. Microprocessor 152 has SENSE and RECEIVE DATA inputs.

Communication line 154 is connected through probe 84 to a microcontroller 170 in lock mechanism 30, the microcontroller receiving operating power from a voltage regulator 172 which is connected to the communication line 154 through an isolation diode 174. A capacitor 176 connected between voltage regulator 172 and diode 174 is connected to ground. Microcontroller 170 provides outputs to a data transmitting switching transistor 180 and to a power switching transistor 184 connected between solenoid 76 and ground. Microcontroller 170 has a RECEIVE DATA input connection to communication line 154.

FIG. 6 is a timing/logic diagram for the circuitry shown on FIG. 5. A complete unlock/lock sequence is divided into seven segments, A–G. Segment A is wrench insertion, going from an out position to an in position. During that time, communication line 154 (FIG. 5) and resistor 156 are at full battery voltage V1. At the point that probe tip 464 (FIG. 4B) makes contact with printed circuit board 48', the voltage on communication line 154 drops to a value determined by a voltage divider network comprising resistors 156 and 178, here, voltage V3. A comparator (not shown) at SENSE input to microprocessor 152 receives voltage V3 and, since V3 is between voltage limits V2 and V4, the output of the comparator goes positive providing a presence sense signal in the microprocessor. The presence sense signal stays at that condition until removal of the wrench. The comparator window is provided so that, if there is a short circuit on insertion of the wrench, the sequence will not be started.

Once the presence sense signal is established, microprocessor 152 starts charging, segment C, by turning on transistor 160 which shorts resistor 156 and charges capacitor 176 through diode 174. Voltage regulator 172 starts to provide operating power for microcontroller 170. Capacitor 176 maintains a charge on voltage regulator 172 during the communication cycle and diode 174 isolates the voltage on capacitor 176 from being discharged. At the end of segment C, transistor 160 is turned off.

Segment D is the communication segment in which transistors 162 and 180 are alternately turned on depending on whether microprocessor 152 or microcontroller 170, respectively is transmitting during bidirectional communications. Turning on either transistor 162 or 180 pulls down resistor 156 which becomes a pull up resistor. Microprocessor 152 first sends microcontroller 170 an interrogation signal. Microcontroller 170 answers with the serial number of lock mechanism 30. If the serial number corresponds with one stored in microprocessor 152, that is, it identifies a lock that is to be unlocked at this time, microprocessor 152 transmits a password to microcontroller 170 and then turns on transistor 160 to provide power for solenoid 76. When microcontroller 170 verifies the password, it turns on transistor 184, activating solenoid 76 and releasing latch bar 70 from cam 46. Cam 46 can then be rotated, forcing slide bolt 34 (FIG. 2) into housing 32.

Rotation of wrench 80 during segment E leads to unlock segment F during which transistor 184 is turned off. During this segment, the presence sense signal is still positive and microcontroller 170 continues to output an unlocked signal to microprocessor 152. Wrench 80 cannot be removed from lock mechanism 30 unless the wrench is rotated back to the zero position.

In the final, unlock, segment G, wrench 80 is rotated and removed, while communication line 154 is again pulled up to battery voltage, V1, and the presence sense signal drops to zero.

A number of methods may be used to provide the password to microcontroller 170 from microprocessor 152. For further security, microcontroller 170 may be provided with a real time clock so that a time encryption method may be used advantageously. Such a method is described in copending U.S. patent application Ser. No. 07/520,763, filed May 9, 1990, by James S. Bianco et al, titled "Method and Means to Limit Access to Computer Systems," now U.S. Pat. No. 5,067,155, issued Nov. 19, 1991, the disclosure of which is incorporated by reference hereinto. In the method described therein, an accessing device encrypts identification information with real time so that the resulting password can be used only for a limited, predetermined period of time.

Figure 7:
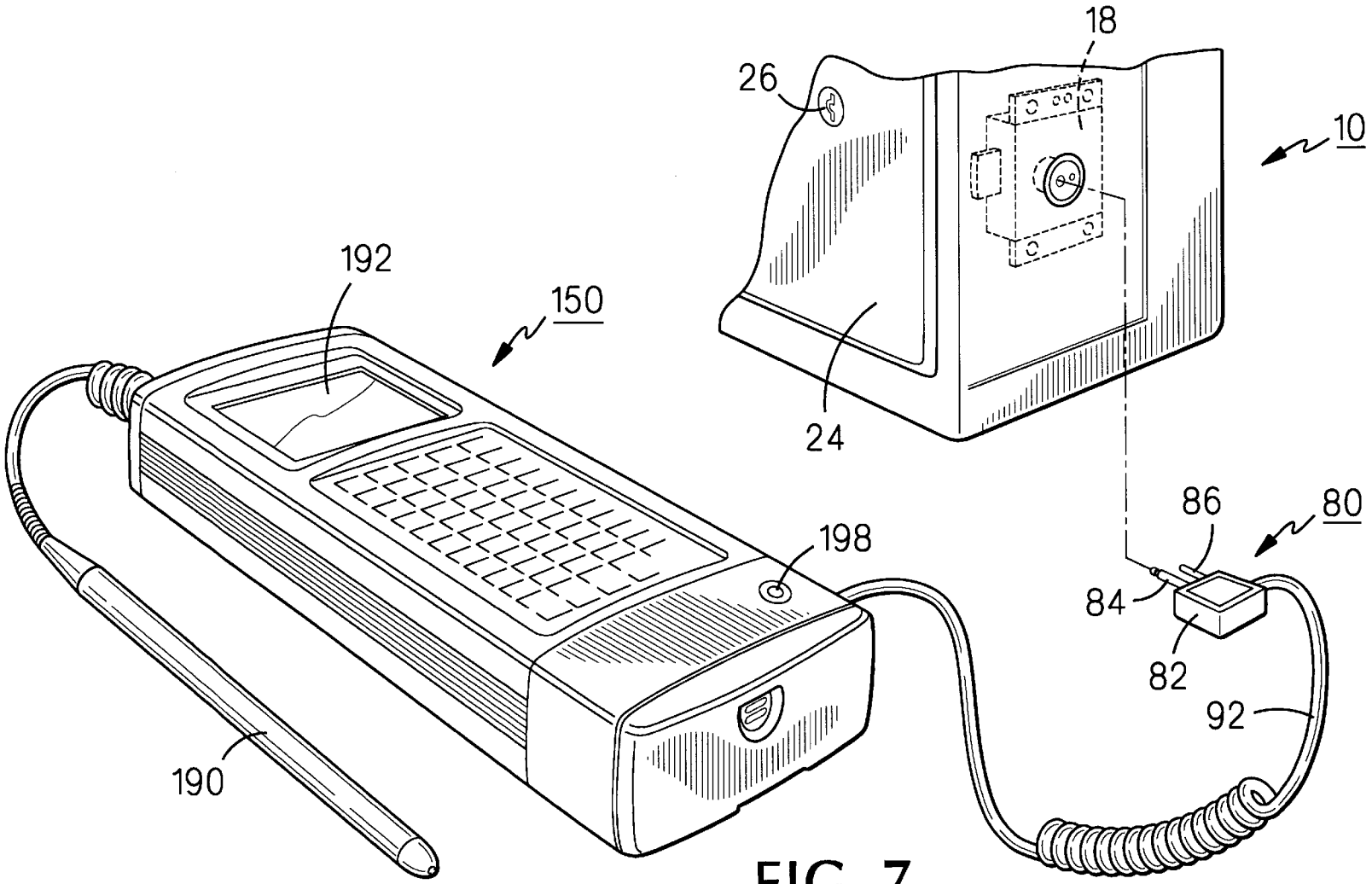
FIG. 7 is a perspective view of the hardware components of the embodiment of FIG. 2.

FIG. 7 illustrates a hardware embodiment of the present invention, including wrench 80 attached to computer 150 by cable 92 to form a compact, easily carried unit. Computer 150 has attached thereto a bar code reading wand 190 which may be used to scan bar codes on coin boxes and for other input functions. Computer 150 further includes a data display 192 and a keyboard 194 for manual input of data. Also included in computer 150 is an LED 198 which provides a visual indication when solenoid 76 (FIG. 5) has been energized and wrench 80 can be rotated to unlock lock mechanism 30.

Prior to the beginning of collection rounds, data as to route, serial numbers of telephones to be accessed, and other information can be downloaded by a main computer to computer 150. At the same time, battery 148 in computer 150 can be replaced or recharged as necessary.

Figure 8:
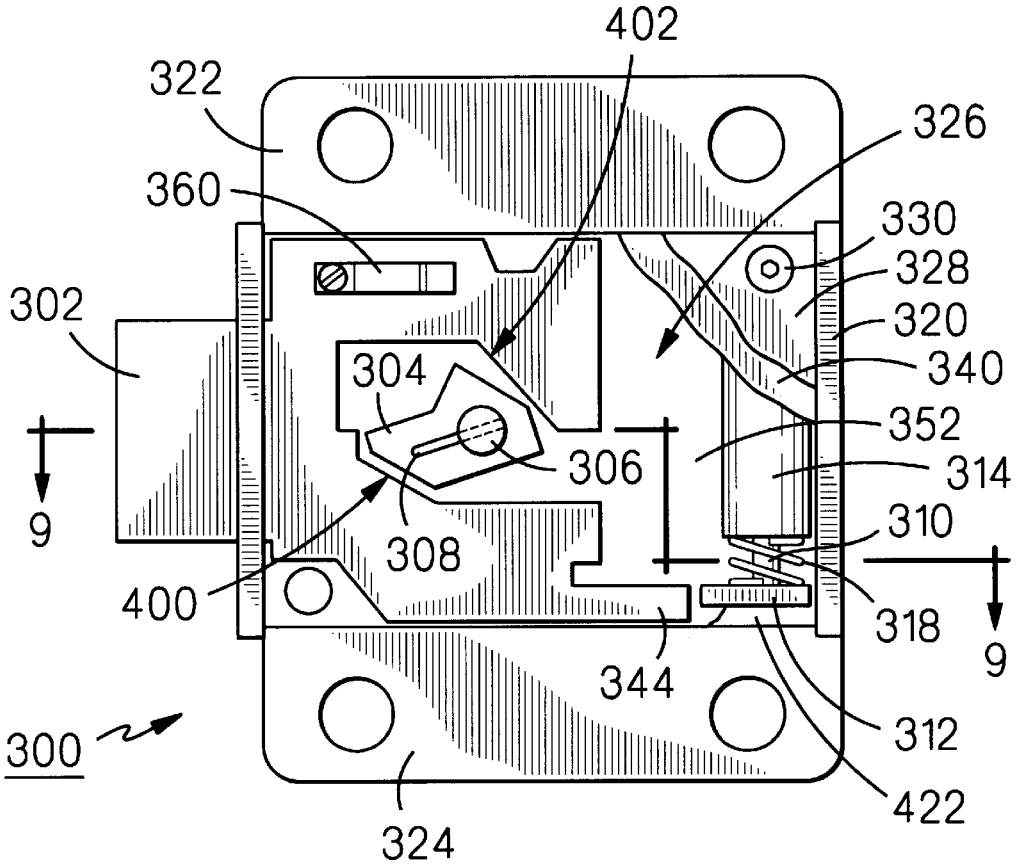
FIG. 8 is a front elevational view, partially cut away, of an alternative lock mechanism embodiment according to the present invention.
Figure 9:
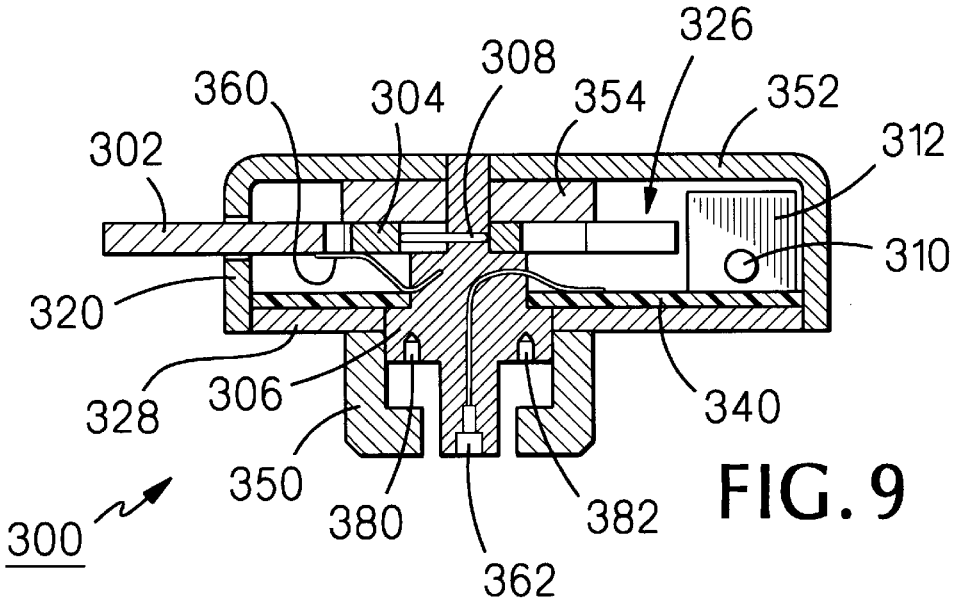
FIG. 9 is a cross-sectional view taken along line "9—9" of FIG. 8.
Figure 10:
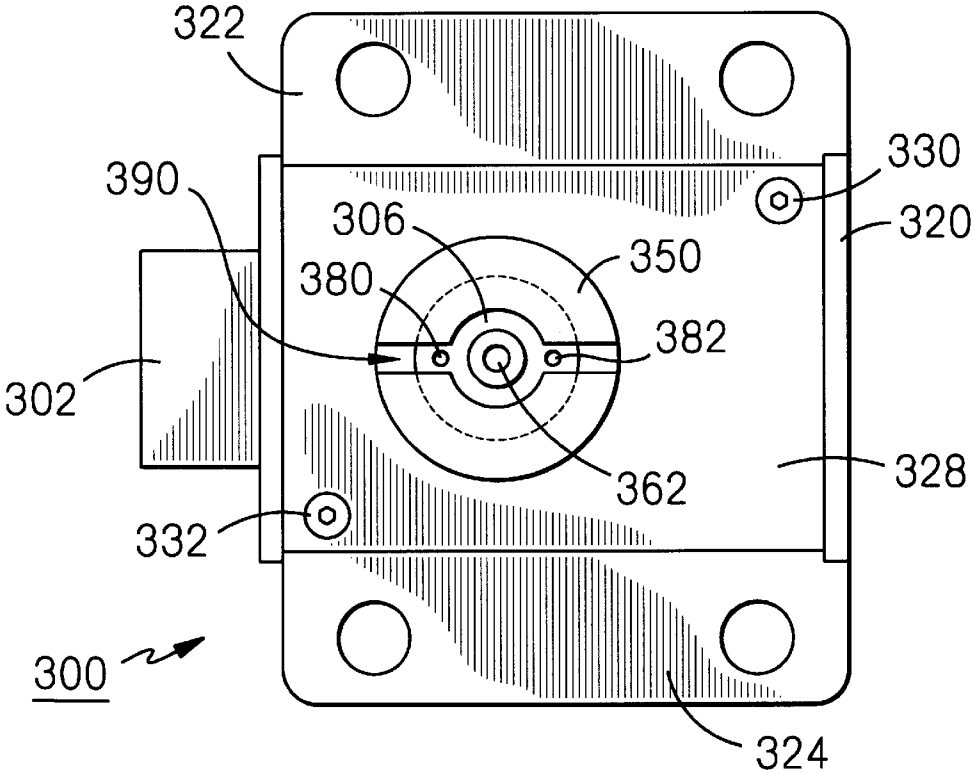
FIG. 10 is a front elevational view of the embodiment of FIG. 8.

FIGS. 8–10 illustrate an alternative preferred embodiment of a lock mechanism, generally indicated by the reference numeral 300.

Referring primarily to FIGS. 8 and 9, lock mechanism 300 is characterized in that it is very simple, having only three moving parts: a slide bolt 302, a cam 304 fixedly mounted on a drive shaft 306 by means of a shear pin 308, and a solenoid plunger 310 on the distal end of which is fixedly mounted a stop 312. Solenoid plunger 310 moves up and down within a solenoid body 314 (FIG. 8).

The foregoing moving parts are disposed in a housing 320 having extending therefrom mounting flanges 322 and 324. An internal cavity 326 is defined internally of housing 320, which internal cavity is closed by means of a cover plate 328 attached to housing 320 by means of screws 330 and 332 (FIG. 10). A printed circuit board 340 is disposed against the inner surface of cover plate 328. A cylindrical wrench retainer 350 (FIGS. 9 and 10) is fixedly attached to and extends orthogonally outwardly from cover plate 328 and drive shaft 306 is journaled in, and extends between, the wrench retainer and the rear wall 352 (FIG. 9) of housing 320. A spacer 354 is disposed parallelly between slide bolt 302 and rear wall 352. Slide bolt 302 is disposed for back-and-forth horizontal motion within housing 320.

In use, lock mechanism 300 operates in a very similar manner to the way lock mechanisms 30 and 30' (preceding figures) operate, except for two very important features. The first feature is that slide bolt 302 has mounted thereon a wiper contact 360 which contacts printed circuit board 340 to permit sensing of the position of the slide bolt. This is important for it allows sensing that bolt 302 is in the locked position notifying external electronics of that fact. The information can be duly noted in the transaction data that lock mechanism 300 was physically unlocked and then locked. This is required for audit purposes.

The second feature is that stop 312 engages a contact on printed circuit board 340 when lock mechanism 300 is in the locked position (FIGS. 8 and 9). Thus, it can easily be sensed that solenoid plunger 310 has returned to the locked position and is not stuck inside solenoid body 314, leaving slide bolt 302 in the locked position but without stop 312 in the locked position such that lock mechanism 300 could be unlocked without the necessary electronic clearance. If some one should tamper with stop 312 or plunger 310, that fact would be duly noted when the next time lock mechanism 300 were used and the data collected.

Another of the important features of lock mechanism 300 is that it is sealed at the point of exposure to the outside and, therefore, extremely protected against tampering. As is shown on FIG. 9, drive shaft 306 seals against the inner wall of wrench retainer 350 and an electrical contact 362 is disposed concentrically within the wrench retainer external to housing 320.

Figure 11:
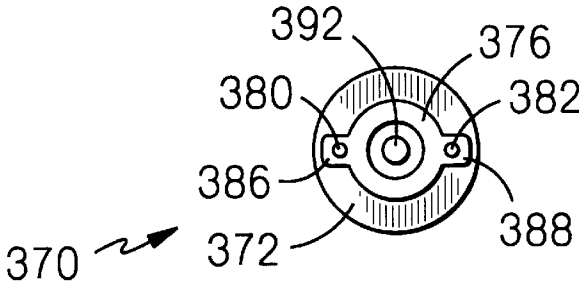
FIG. 11 is a side elevational view of a wrench for use with the lock mechanism of FIGS. 8–10.
Figure 12:
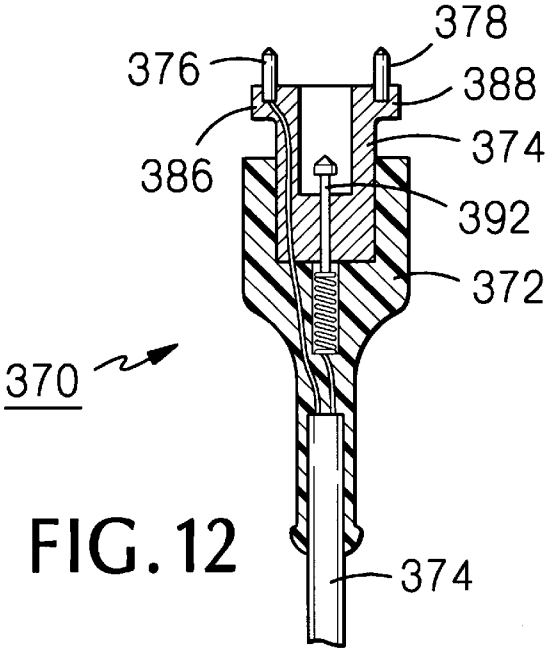
FIG. 12 is a top plan view, partially in cross-section, of the wrench of FIG. 11.

Referring now to FIGS. 11 and 12, there is illustrated a wrench, generally indicated by the reference numeral 370, for use with lock mechanism 300 (FIGS. 8–10). Wrench 370 includes a generally cylindrical housing 372 having a two-conductor wire extending from the proximal end thereof and a drive pin holder 374 extending from the distal end thereof. Mounted in and extending axially from drive pin holder 374 are two drive pins 376 and 378 which are insertable in drive sockets 380 and 382 (FIGS. 9 and 10) defined in the end of drive shaft 306.

Drive pin holder 374 has two, opposed tabs 386 and 388 in which drive pins 376 and 378 are mounted, respectively, extending outwardly from the central portion of the drive pin holder so as to form a bar shape interrupted by the central portion of drive pin holder. A spring-loaded contact pin 392 is disposed axially centrally of wrench 370 and is connected to the positive of the two conductors of wire 374. The ground conductor of wire 374 is connected to at least one of drive pins 376 and 378.

So configured, drive pin holder 374 is insertable into wrench retainer 350 so that tabs 386 and 388 engage a wrench slot 390 (FIG. 10) defined in the wrench retainer, drive pins 376 and 378 are inserted in drive sockets 380 and 382, and spring-loaded contact 392 engages contact 362.

Wrench slot 390 (FIG. 10) serves as a clean-out slot and allows chewing gum and the like to be easily removed by a simple tool or pick. Spring-loaded contact 392 in wrench 370 is protected against static and damage for and forming housing 372 of plastic further reduces the possibility of static.

Lock mechanism 300 works in a simple fashion as follows: When wrench 370 is inserted into wrench retainer 350, drive pins 376 and 378 engage drive sockets 380 and 382 and, among other points of contact, this establishes a ground for the electronic circuit. Spring-loaded contact pin 392 in wrench 370 contacts the center contact in lock mechanism 300 and establishes a path for power and communications.

As before, with lock mechanisms 30 and 30', when power and communications are established between wrench 370 and lock mechanism 300, the decision is made whether access is permitted or denied. If access is denied, it will be impossible to rotate wrench 370 in either direction. (See FIG. 8). Rotation counterclockwise is stopped by cam 304 striking slide bolt 302 at surface 400. Rotation clockwise causes cam 304 to strike slide bolt 302 at surface 402. Cam 304 then causes slide bolt 302 to slide to the right until the bolt hits stop 312. Further travel of slide bolt 302 is prevented by the stop, for it is forced against the wall of housing 320. Continued pressure clockwise of drive shaft 306 by the wrench will cause shear pin 308 to sever, thus rendering the drive shaft useless and preventing forced entry.

If access is permitted, solenoid 314 will cause solenoid plunger 310 to retract and compress a return spring 318. Stop 312 will thereby be moved out of the way of slide bolt and clockwise rotation of drive shaft 306 will cause cam 304 to move slide bolt 302 to the right on FIG. 8 into the retracted or open position. As soon as wiper contact 360 on slide bolt disconnects from a sense point on printed circuit board 340, the power to solenoid 314 is removed at that point, greatly reducing the power drain on the batteries energizing the solenoid. When drive shaft 306 is turned approximately 45 degrees clockwise, a flange 344 extending from the right side of slide bolt 302 will strike the right side of housing 320 (FIG. 8). At this point, slide bolt 302 is completely retracted and lock mechanism 300 is open. It should be noted that when the power is removed from solenoid 314, spring 318 cannot return stop 312 to the locked position for it is held in the compressed position by bolt flange 344. When wrench 370 is turned counterclockwise approximately 35 degrees, stop 312 will slide off slide bolt flange 344 into the locked position, thus striking the contact sense point on the printed circuit board 340.

Wrench 370 may only be removed from wrench retainer 350 when wrench tabs 386 and 388 are aligned with wrench slot 390 in the retainer ring. This prevents the accidental removal of wrench 370 when lock mechanism 300 is in the open position. Note that slide bolt 302 allows stop 312 to return to the locked position when drive shaft 306 is only returned 35 degrees counterclockwise. The remaining 10 degrees is to insure that the lock is closed before the wrench is removed.

Figure 13:
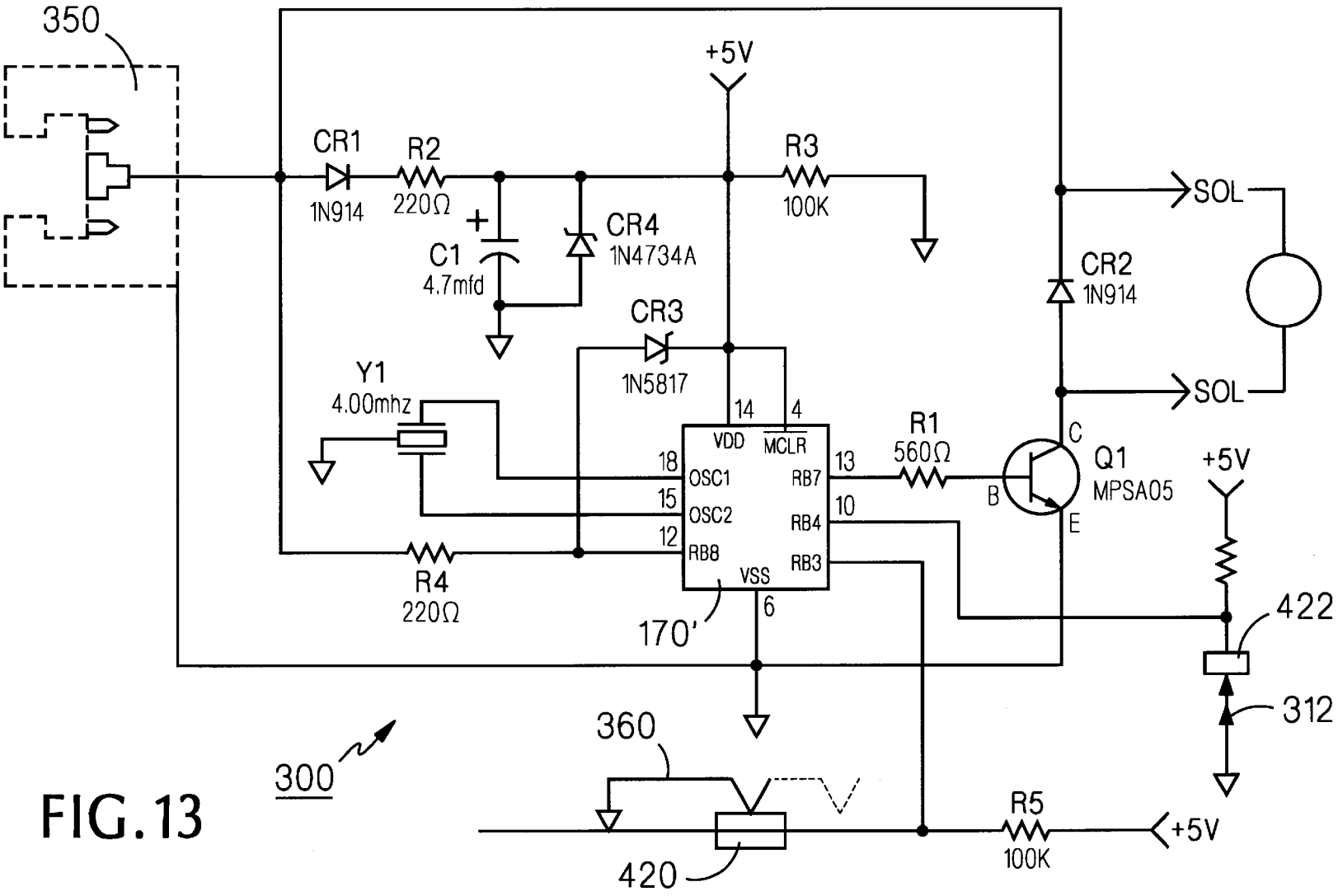
FIG. 13 is a schematic diagram illustrating the electrical/electronic circuitry of the lock mechanism of FIGS. 8–10.

Referring now to FIG. 13 there is illustrated the electrical/electronic circuitry of lock mechanism 300. Since the basic operation thereof is the same as described with reference to lock mechanism 30 on FIG. 5, the description of the basic operation will not be repeated here. The differences are that lock mechanism 300 provides an input from wiper contact 360 to microcontroller 170' and stop 312 also provides an input thereto. Wiper contact 360 moves between a position in contact with a sense point 420 on printed circuit board 340 (FIG. 9) when lock mechanism 300 is in its closed position and a position out of contact with the sense point when the lock mechanism is in its open position. Stop 312 moves between a position in contact with a sense point 422 on printed circuit board (FIGS. 8 and 9), providing an input to microcontroller 170' when lock mechanism 300 is locked and a position not in contact with the sense point when the lock mechanism is unlocked.

Figure 14:
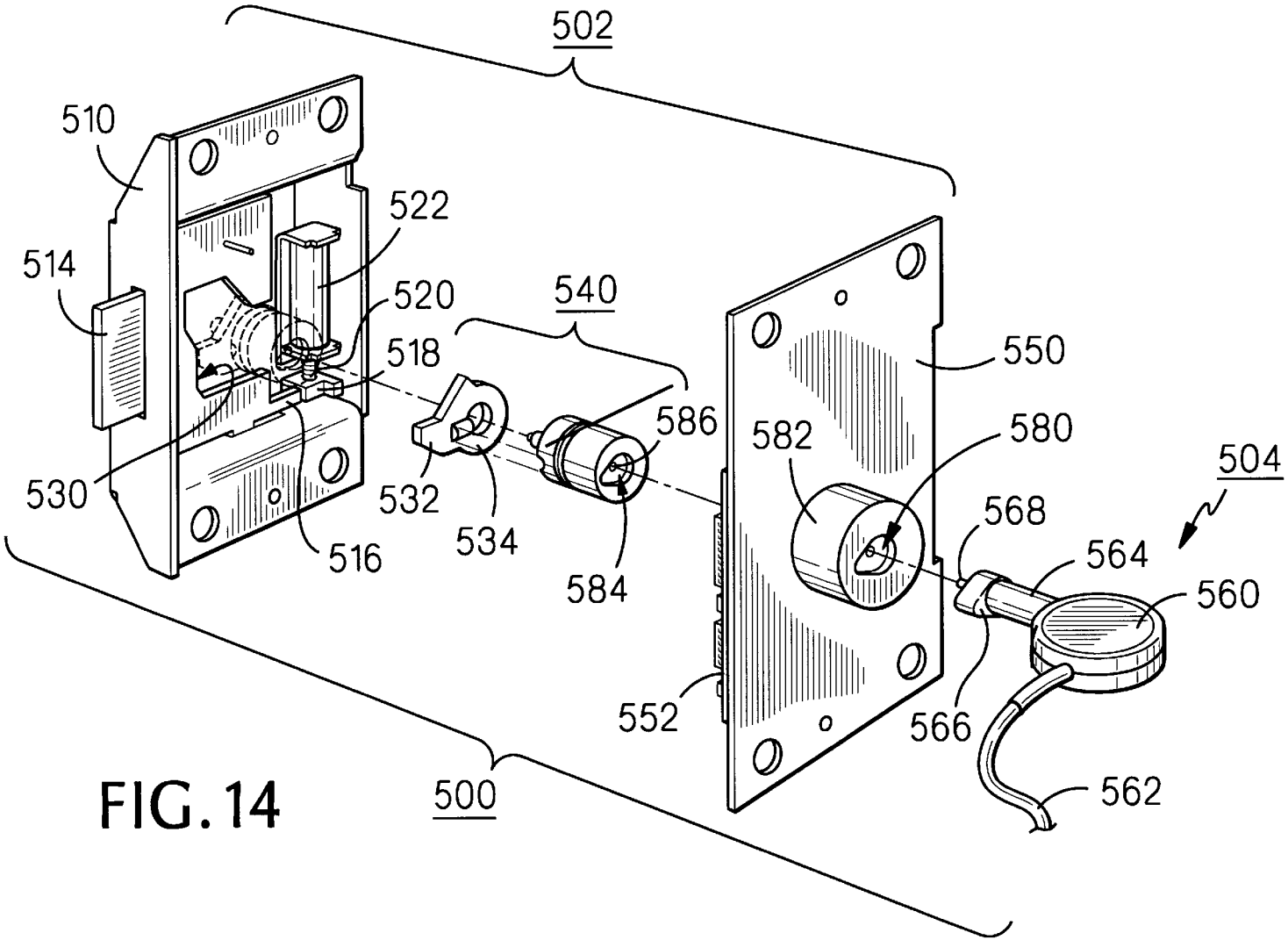
FIG. 14 is an exploded perspective view showing the major elements of another intelligent lock/key system according to another aspect of the invention.

FIG. 14 illustrates the major elements of another lock/key system, according to the present invention, generally indicated by the reference numeral 500. Lock/key system 500 includes a lock assembly 502 and a key assembly 504, which may communicate electrically as described above with reference to FIGS. 5, 6, and 13; although, other unlocking protocols may be employed as well.

Lock assembly 502 includes a generally cup-shaped housing 510 in which is disposed for back-and-forth movement therein a slide plate 512 having a locking tongue 514 formed at one edge thereof and extending through a wall of the housing when the device (not shown) of which the lock assembly is part is in its locked condition. Movement of slide plate 512 to an unlocked position is prevented by the engagement of a tab 516, formed at the other end of the slide plate, with a stop plate 518 disposed at the end of a plunger 520 of a solenoid 522. Such movement of slide plate 512 is also prevented by the engagement of an inner wall 530 of the slide plate with an end 532 of a cam plate 534 forming part of a barrel assembly, the latter generally indicated by the reference numeral 540. Housing 510 is closed by a cover plate 550 having a printed circuit board 552, with electrical components mounted thereon, attached to the inner surface thereof. Solenoid 522 is mounted to printed circuit board 552.

Key assembly 504 includes a body portion 560 attached to a power/communications cable 562 attached to power and communications circuitry (not shown) and having a shaft 564 fixedly attached to and extending from an edge thereof. Fixedly disposed at the distal end of shaft 564 is an oblong lobe 566 having a communications contact 568 centrally disposed in the distal face thereof. Oblong lobe 566 is insertable in a complementarily shaped opening 580 formed in a housing member 582, fixedly attached to the outer surface of cover plate 550, for insertion in a complementarily shaped opening 584 formed in the end of barrel assembly 540, with communications contact 568 in engagement with a communications contact 586 disposed centrally at the base of opening 584.

Figure 15:
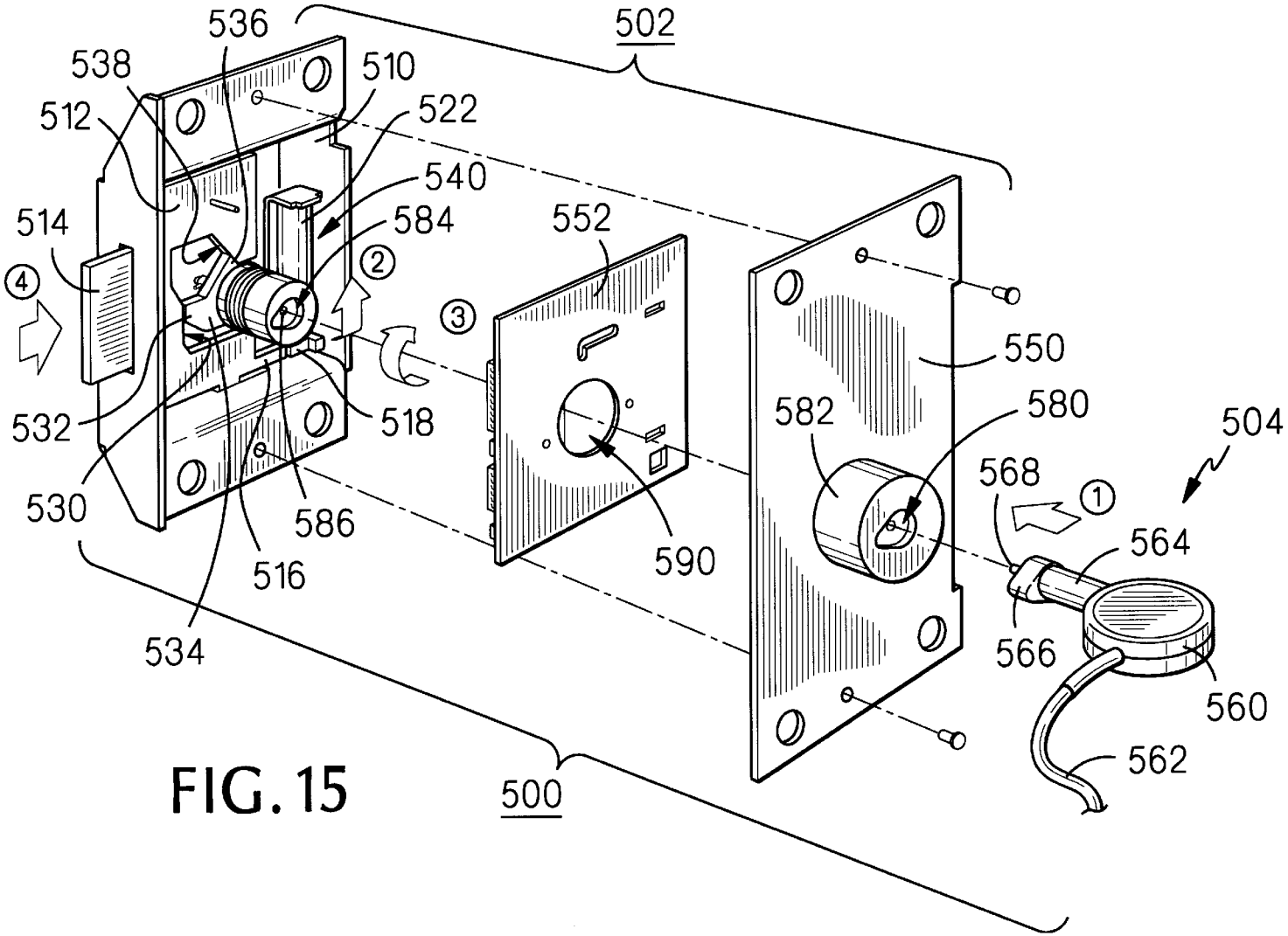
FIG. 15 is an exploded perspective view showing the operation of the embodiment of FIG. 14.

To unlock lock 502, first, oblong lobe 566 is inserted into opening 580 of housing member 582 through an opening 590 defined through circuit board 552 and into opening 584 in barrel assembly 540. As lobe 566 is inserted into opening 580, the sides of the lobe closely engage or pass by the walls of the opening, thus grounding any static electricity present on the lobe and key 504. With lobe 566 inserted into opening 584, communications contacts 568 and 586 are engaged and appropriate identification and unlocking signals are exchanged therebetween. When unlocking power is provided, solenoid 522 withdraws its plunger 520 (FIG. 14), thus drawing stop plate 518 from engagement with tab 516. Then key 504 can be rotated clockwise, with a shoulder 536 on cam plate 534 engaging a sloped surface 538 on slide plate 512, forcing the slide plate to the right on FIG. 15 and drawing locking tongue 514 into housing 510 to place lock 502 in the unlocked condition. Locking of lock 502 is accomplished by completing the above steps in reverse order.

Figure 16:
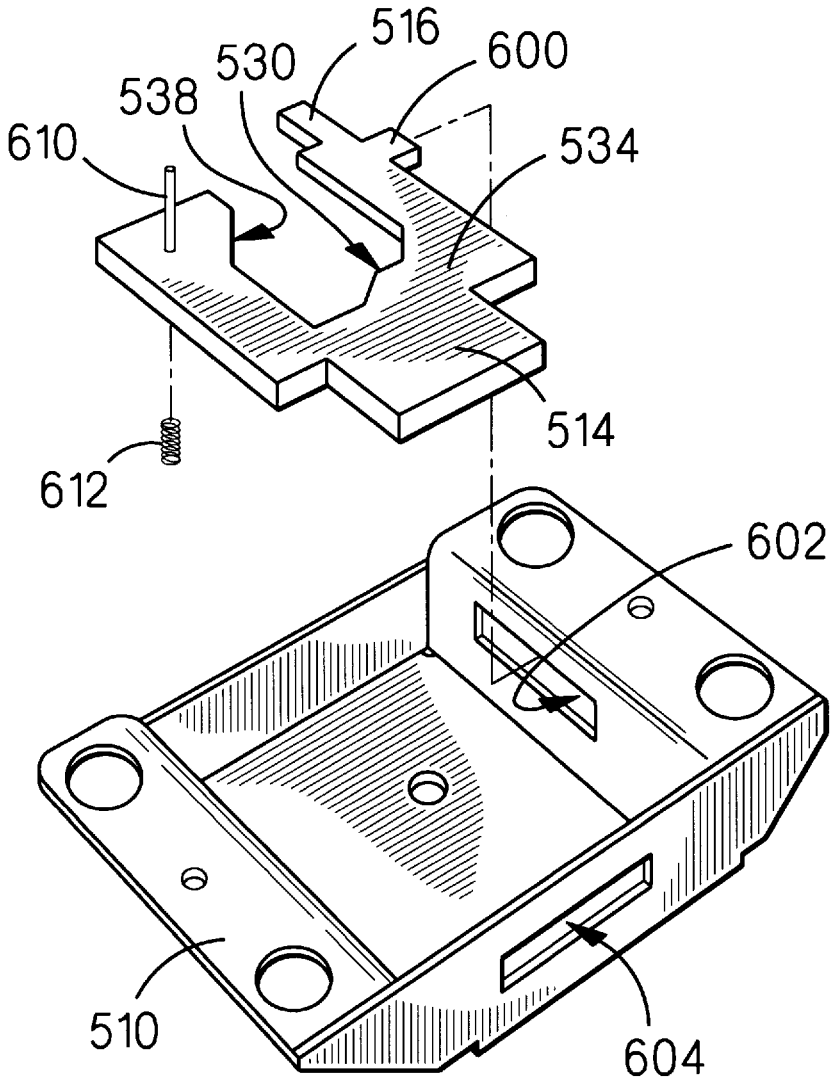
FIGS. 16 and 17 are exploded perspective views showing construction details of the embodiment of FIG. 14.

FIG. 16 further illustrates the arrangement of slide plate 512 and housing 510. Slide plate 512 includes a guide tab 600 which is dimensioned for back and forth movement in a guide slot 602 defined in a wall of housing 510 as the slide plate moves between unlocked and locked (FIGS. 14 and 15) positions. A slot 604 is defined in another wall of housing 510 for the movement outward and inward therein of locking tongue 514. Slide plate 512 further includes a pin 610 extending orthogonally from the inner surface of the slide plate, the purpose of which pin will be described below with reference to FIG. 17. A coil spring 612 is disposed between the outer surface of slide plate 512 and the inner surface of the rear wall of housing 510 to help support and position the slide plate in the housing.

Figure 17:
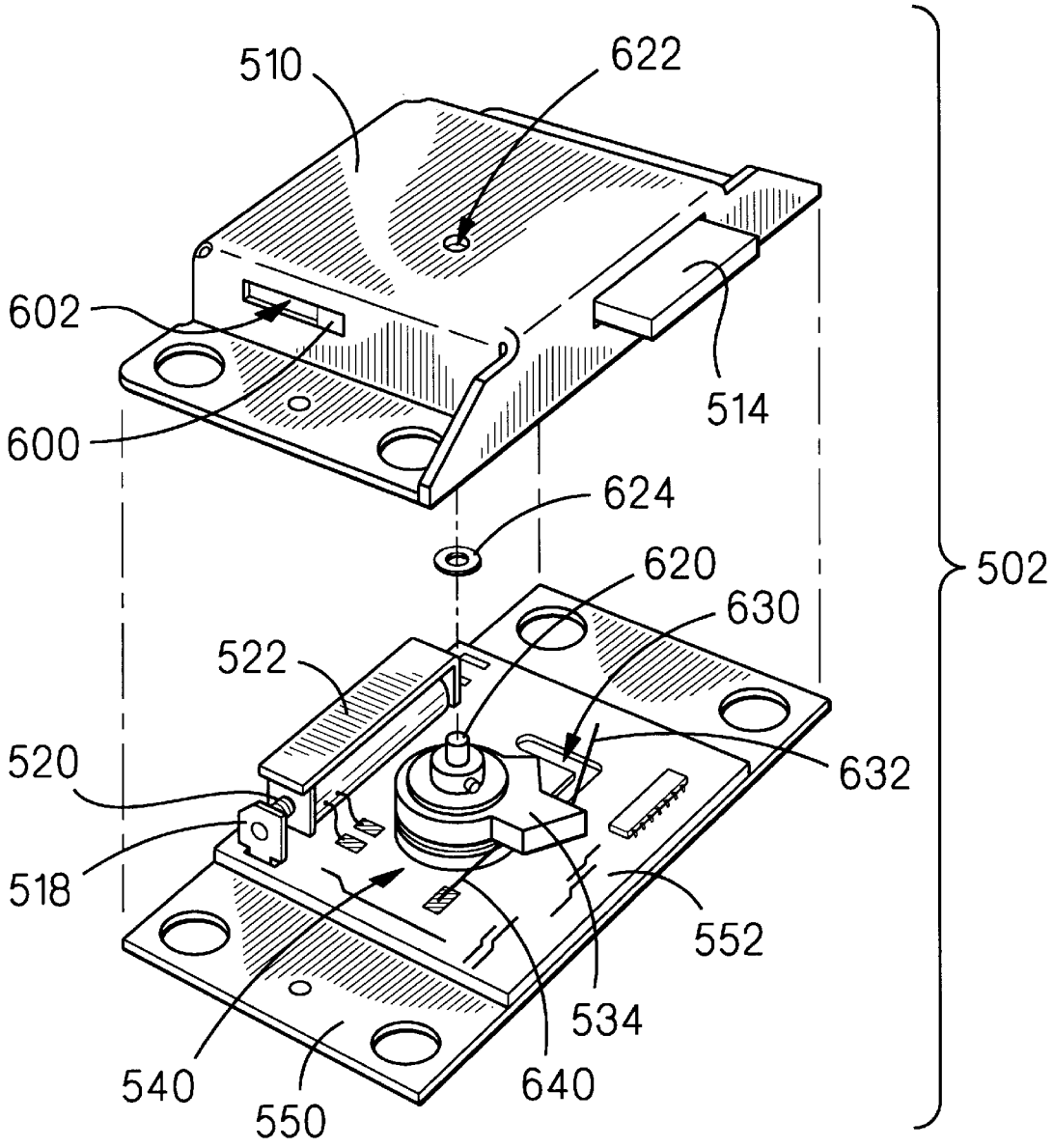

FIG. 17 further illustrates the arrangement of housing 510 and cover plate 550 and shows solenoid 522 and barrel assembly 540 in place on printed circuit board 552. The distal end of barrel assembly 540 terminates in an inner shaft 620 which, when lock 502 is assembled, fits into an opening 622 defined in the rear wall of housing 510. A wave washer 624 disposed on inner shaft 620 and against the inner surface of the rear wall of housing 510 provides positive force to seat barrel assembly 540.

FIG. 17 also shows a slot 630 defined in printed circuit board 552 having an electrical contact wire 632, attached to the circuit board, disposed at one end of the slot. As slide plate 512 moves between locked and unlocked positions, the distal end of pin 610 (FIG. 16) moves back and forth in slot 630. When slide plate 512 is in the locked position, pin 610 touches contact wire 632, thus completing a circuit and giving positive electrical indication that the lock 502 is in locked position. FIG. 17 also shows a communication contact wire 640 attached to printed circuit board 522 which wire contacts barrel assembly 540.

Figure 18:
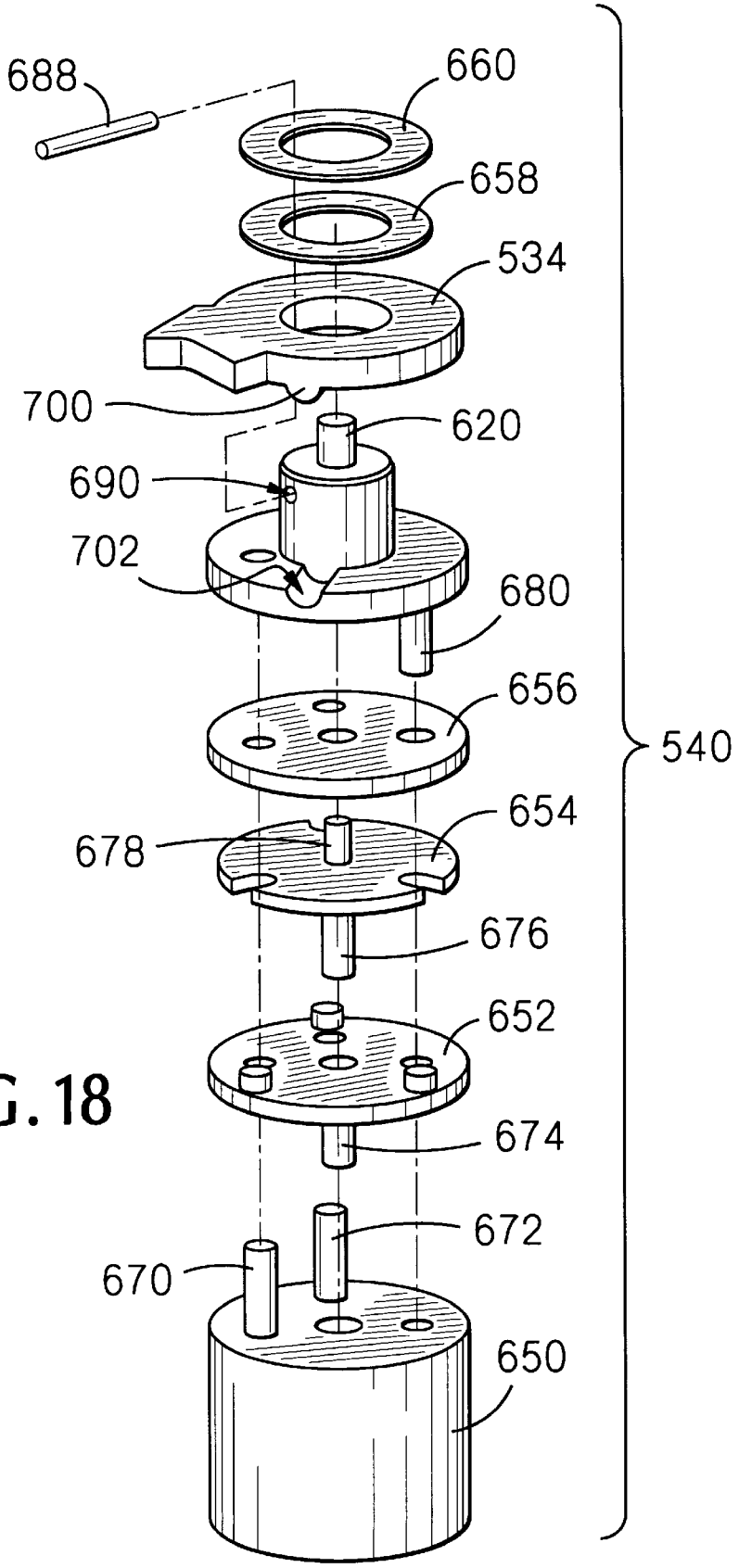
FIG. 18 is an exploded perspective view of the barrel assembly of FIG. 14.

FIG. 18 illustrates the elements of barrel assembly 540 which include, in order, an outer shaft 650 in the face of which (FIG. 15) is defined opening 584, an insulator 652, a contact plate 654 which is contacted by communication contact wire 640 (FIG. 17) and which is electrically connected to communications contact 586 (FIG. 15), an insulator 656, inner shaft 620, cam plate 534, and cupped washers 658 and 660. All of the foregoing elements of barrel assembly 540, except cam plate 534, and cupped washers are aligned and are secured against relative rotational movement by means of pins 670, 672, 674, 676, 678, and 680 disposed as shown. Inner shaft 620 and cam plate 534 are yieldingly secured against relative axial movement by means of the compression of cupped washers 658 and 660 between the upper surface of cam plate 534 and a dowell pin 688 inserted into an opening 690 defined through inner shaft 620. A detent is formed between inner shaft 620 and cam plate 534 by means of a raised portion 700 on the cam plate which engages a complementarily shaped channel 702 defined in a horizontal shoulder on the inner shaft.

Figure 20:
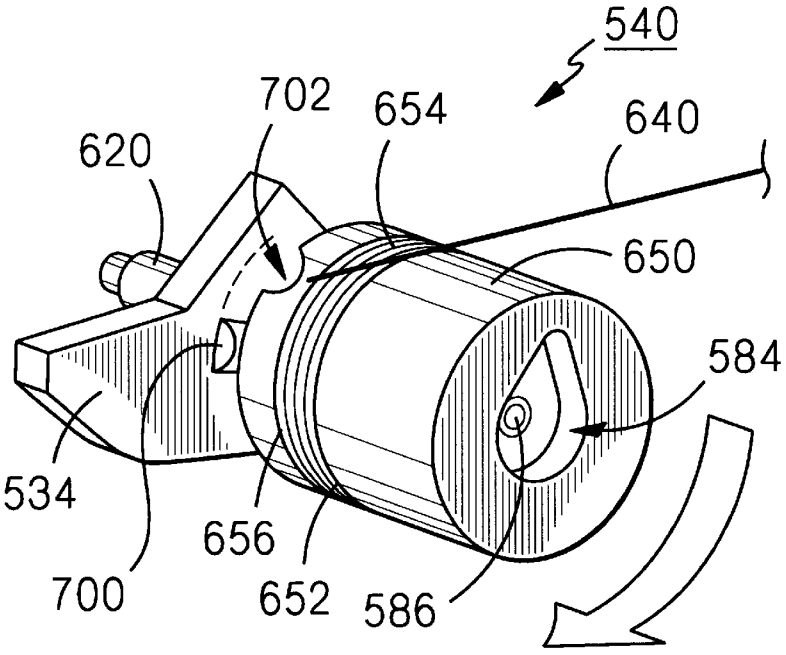
FIG. 20 is a perspective view showing the barrel of the lock of FIG. 15 when unauthorized, forced entry is attempted.
Figure 19:
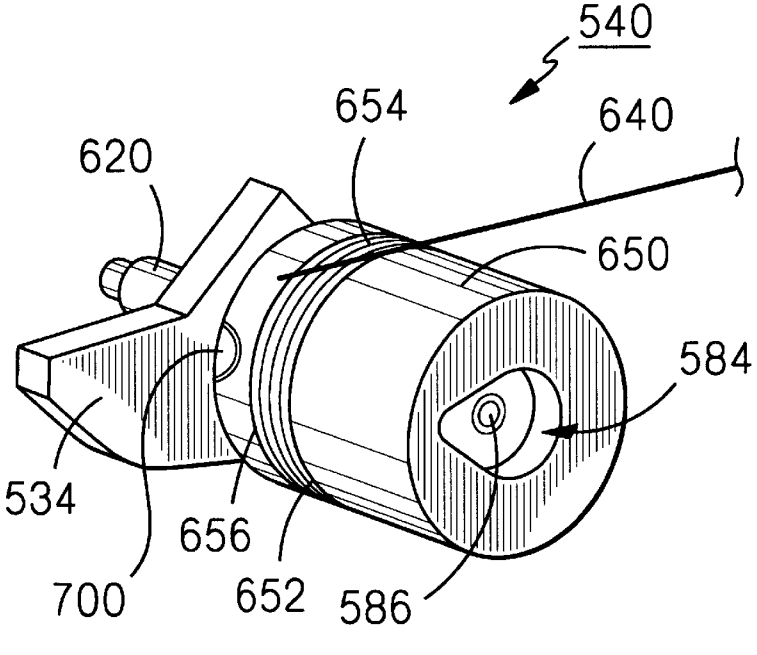
FIG. 19 is a perspective view showing the barrel of the lock of FIG. 14 in normal position.

FIG. 19 illustrates barrel assembly 540 in its normal configuration. The strength of cupped springs 658 and 660 (FIG. 18) is sufficient to keep elements 700 and 702 fully engaged while barrel assembly 540 is rotated to lock and unlock lock 502. If, however, there is an attempt to forcibly unlock lock 502 by rotating barrel assembly 540, cupped springs 658 and 660 will compress and elements 700 and 702 will disengage and permit the elements of the barrel assembly to rotate without damage. This is illustrated on FIG. 20. Since the communications contact wire 640 is in sliding contact with communications contact plate 654, no electrical connection is broken. When authorized entry is again attempted, barrel assembly 540 is rotated to its detented position (FIG. 19) and the normal unlocking procedure followed, without the necessity to repair any elements.

Figure 21:
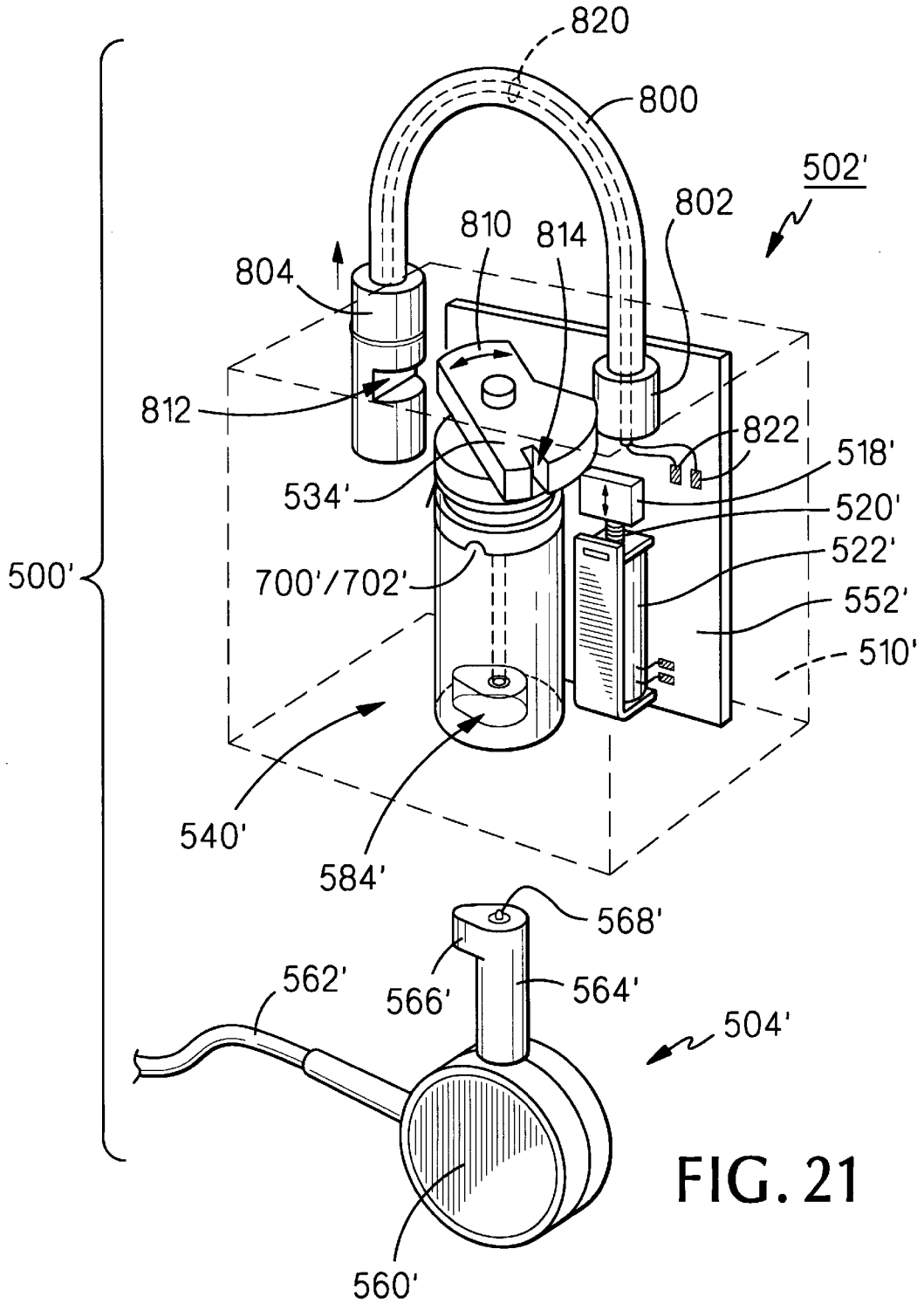
FIG. 21 is a perspective view of an alternative embodiment of the lock of FIG. 14 useful for locking cargo containers.

FIG. 21 illustrates an alternative embodiment of lock/key system 500 shown on FIGS. 14–20, this embodiment generally indicated by the reference numeral 500'. Elements of lock/key system 500' similar in function to those of lock/key system 500 are given primed reference numerals. Rather than employing a slide plate for locking purposes, lock 502' employs a cable 800 which may be used to secure the door of a cargo container (not shown), for example. Cable 800 has a fixed end 802 attached to housing 510' and a free end 804 which may be inserted and releasably secured in the housing.

Cam plate 534' includes a locking extension 810 at one end thereof which is insertable in a complementarily dimensioned slot 812 defined in free end 804 of cable 800. Cam plate 534' further includes a slot 814 defined in the opposite end thereof in which slot complementarily dimensioned stop plate 518' is insertable. Cam plate 534' is rotatable between an open position, as shown on FIG. 21, and a closed position in which locking extension 810 is inserted in slot 812 and stop plate 518' is inserted in slot 814. The unlocking procedure is similar to that described with reference to the unlocking of lock/key 500 on FIG. 15.

An important feature of lock/key 500' is the provision of a conductive wire 820 disposed in cable 800 to form a continuous loop therethrough, with ends of the wire connected at pads 822 to printed circuit board 552'. Should cable 800 be severed and then repaired, information as to the same can be stored on printed circuit board 552' and noted when the cargo container reaches its destination.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

I claim:

1. Electronic lock system, including lock means comprising:

(a) a lock housing having disposed therein electronic lock apparatus;

(b) a cover disposed over the front of said lock housing;

(c) a rotatable barrel disposed in said lock housing to unlock said lock apparatus when said rotatable barrel is rotated, said rotatable barrel being accessible through an opening defined in said cover and having an external electrical contact thereon;

(d) said rotatable barrel having at least one drive socket defined therein and spaced radially from said electrical contact;

(e) a wrench retainer fixedly attached to said cover, said wrench retainer having a wall member axially spaced apart from said cover, defining a space between said wall member and said cover; and (f) said wrench retainer having an opening defined through said wall member, through which opening said barrel is accessible;

and said electronic lock system includes wrench means comprising:

(g) a wrench housing;

(h) an electrical contact disposed in the distal end of said wrench housing;

(i) drive means, insertable in said drive socket, extending from the distal end of said wrench housing; and (j) said drive means and said electrical contact being disposed such that they may be inserted into said opening in said wrench retainer, with said electrical contacts in said wrench means and said rotatable barrel in engagement, said drive means inserted into said drive socket, and said drive means being rotatable within said space defined between said wall member of said wrench retainer and said cover of said housing.

2. Electronic lock system, as defined in claim 1, wherein said drive means cannot be removed from said wrench retainer after said drive means is rotated within said space defined between said wall member of said wrench retainer and said cover of said housing.

3. Electronic lock system, as defined in claim 1, wherein said opening defines an open-ended slot extending across said wrench retainer to permit the freeing of foreign material from the interior of said wrench retainer.

4. Electronic lock system, as defined in claim 1, wherein said wrench retainer is electrically grounded and said wrench retainer and said wrench housing being configured such that, as said wrench means is thrust toward said lock means to insert said drive means in said drive socket, said wrench housing will pass closely to said grounded wrench retainer to discharge static electricity from said wrench means through said grounded wrench retainer.

5. Electronic lock system, including lock means comprising:

(a) a lock housing having disposed therein electronic lock apparatus;

(b) a cover disposed over the front of said lock housing;

(c) rotatable means disposed in said lock housing to unlock said lock apparatus when said rotatable means is rotated, said rotatable means being accessible through an opening defined in said cover and said rotatable means having an external electrical contact thereon;

(d) said rotatable means having a drive socket defined therein;

(e) electrically grounded structure surrounding said opening;

and said electronic lock system includes wrench means comprising:

(f) a wrench housing;

(g) an electrical contact in the distal end of said wrench housing and drive means, insertable in said drive socket, and extending from the distal end of said wrench housing; and (h) said grounded structure and said drive means being configured such that, as said drive means is thrust toward said lock means to insert said drive means in said drive socket, a body portion of said drive means will pass closely to said grounded structure to discharge static electricity from said wrench means through said grounded structure before engagement of said electrical contact in said wrench housing and drive means and said external electrical contact in said lock means.

6. A lock system including a lock and a key, comprising:

(a) a lock housing;

(b) a rotatable member disposed in said housing, rotation of which rotatable member selectively effects locking and unlocking of said lock;

(c) blocking means operatively connected to said rotatable member to prevent unlocking of said lock except upon receipt of an electrical unlocking signal;

(d) key means having an end insertable in said housing and into an end of said rotatable member for rotation of said rotatable member;

(e) said rotatable member including communications means disposed on a first portion of said rotatable member;

(f) said lock housing including communications contact means comprising a wire disposed therein in electrical engagement at all times with said communications means on said first portion of said rotatable member; and (g) means to permit said first portion of said rotatable member to rotate to any degree without damage to any elements of said lock if rotation of said rotatable member is attempted without receipt of said electrical unlocking signal.

7. A lock system, as defined in claim 6, wherein:

(a) unlocking of said lock releases a first, releasable end of a cable having a second end fixed to said lock housing; and (b) said cable having therein a conductive wire, severing of which wire will cause information as to the same to be recorded in said lock.

8. A lock system including a lock and a key, comprising:

(a) a lock housing;

(b) a rotatable member disposed in said housing, rotation of which rotatable member selectively effects locking and unlocking of said lock;

(c) blocking means operatively connected to said rotatable member to prevent unlocking of said lock except upon receipt of an electrical unlocking signal;

(d) key means having an end insertable in said housing and into an end of said rotatable member for rotation of said rotatable member;

(e) means to permit a portion of said rotatable member to rotate without damage to any elements of said lock if rotation of said rotatable member is attempted without receipt of said electrical unlocking signal;

(f) unlocking of said lock releases a first, releasable end of a cable having a second end fixed to said lock housing; and (g) said cable having therein a conductive wire, severing of which wire will cause information as to the same to be recorded in said lock.

* * * * *